United States Patent [19]

Linton et al.

[11] 4,274,242

[45] Jun. 23, 1981

[54] BUILDING SYSTEMS

[75] Inventors: Derek Linton; John M. Boydell, both of Wolverhampton, England

[73] Assignee: Pauling and Company Limited, London, England

[21] Appl. No.: 950,874

[22] Filed: Oct. 12, 1978

Related U.S. Application Data

[63] Continuation of Ser. No. 759,514, Jan. 14, 1977, abandoned.

[51] Int. Cl.[3] ..... E02D 27/00

[52] U.S. Cl. ..... 52/741; 52/309.11; 52/371

[58] Field of Search ..... 52/741, 367, 371–373, 52/699, 701, 700, 704, 709, 274, 743; 264/31, 35

[56] References Cited

U.S. PATENT DOCUMENTS

| | | | |
|---|---|---|---|
| 968,573 | 8/1910 | Leather | 52/454 |
| 1,259,698 | 3/1918 | Wilson | 52/223 R |
| 3,432,978 | 3/1969 | Erickson | 52/227 |
| 3,854,260 | 12/1974 | O'Hanlon | 52/584 |
| 3,921,355 | 11/1975 | Pennecot | 52/274 |

*Primary Examiner*—John E. Murtagh
*Attorney, Agent, or Firm*—Neil F. Markva

[57] ABSTRACT

Building frame units and building structures using such frame units as load-bearing wall sections or wall panels are disclosed. The frame units comprise hollow metal sections providing longitudinal frame members, end frame members and intermediate pillar frame members interconnected to form a rectangular skeletal frame. The top and bottom longitudinal frame members and the intermediate pillars are each composed of a pair of flanged channel sections assembled mouth-to-mouth and connected by C-cleats. The end frame members are each formed by a single flanged channel section having its open mouth presented outwardly. At least some frame units incorporate fittings such as windows and doors, but all residual spaces between adjacent frame members are closed by a sheet-like infill of plastics foam material providing a sealing and insulating barrier. A building structure is fabricated by assembling and erecting the frame units in endwise interconnected relationship upon a pre-constructed and levelled horizontal sub-frame base foundation.

10 Claims, 12 Drawing Figures

BUILDING SYSTEMS

This is a continuation, of application Ser. No. 759,514, filed Jan. 14, 1977, now abandoned.

BACKGROUND OF THE INVENTION

The present invention concerns improvements in or relating to building systems, and in particular it relates to the fabrication of building structures of a kind having wall sections or panels provided by skeletal frame units, and to the construction of such frame units.

These wall sections or panels may form load-bearing upstanding external walls and may have a modular size and construction, conforming to standardized dimensions, so as to promote modular assembly methods.

Many forms of building systems employing building frame units of the above-mentioned kind have previously been proposed. However, prior art proposals have generally been less satisfactory than is to be desired, at least in some respects. There is a certain need or demand for improvements, especially to provide versatile and simple practical systems which can have low cost characteristics and which do not have to rely heavily on the availability of skilled labor, especially on site.

SUMMARY OF THE INVENTION

From one aspect, the present invention provides a building frame unit for use as a wall section or panel of a building structure. The unit comprises a rectangular skeletal metal frame built up of spaced-apart elongate longitudinal frame members, adapted to form respective top and bottom horizontal members. The longitudinal frame members are connected together by elongate end frame members, adapted to form vertical end pillars, and one or more intermediate elongate frame members extending between, and connected in selected positions to, said longitudinal frame members. Thus are formed intermediate pillars spaced from and parallel to said end members. The unit has at least one aperture, formed by open spaces of the skeletal frame which may remain between any adjacent frame members, end members or intermediate pillars, after assembling. Other fixtures or components such as windows or doors may be fitted over the open spaces. The unit may be closed over by sheeting composed of plastics material providing a sealing and/or insulating barrier.

In preferred embodiments, wherein the frame members are hollow metal sections, the longitudinal frame members and the intermediate pillars are formed by a pair of flanged channel sections assembled mouth-to-mouth to form a box-like elongate structure. The end frame members are each formed by a single said flanged channel section assembled with its mouth presented outwardly in order to engage in confronting mouth-to-mouth relationship a similar end frame member of a similar frame unit assembled in adjacent aligned end-wise relationship. Most conveniently, the pairs of flanged channel sections forming the longitudinal frame members and the intermediate pillars are connected together after assembly in their opposed confronting relationship by C-cleats engaged with respective pairs of inturned re-entrant flanges thereof.

In general, the frame units are arranged to support and mount additional fixtures or components, such as windows or doors for example, which are accommodated in the openings between pairs of adjacent end units and intermediate pillars. Adjustability or selective positioning of the pillars along the length of the top and bottom longitudinal members can enable the position and spacing of the openings to be varied to suit the dimensions and desired position of the fixtures or components to be so supported and mounted.

Fabrication of the frame units may conveniently and often advantageously be performed, either wholly or mainly, at a location remote from the building site. After assembly and connecting together the frame members, the additional fixtures or components required to be accommodated in the spaces between the adjacent pairs of end members and intermediate pillars are assembled and connected in place. Supplementary support for these additional fixtures or components may also be provided, if desired, by horizontal cross-members or stringers between the end members or intermediate pillars. Then, the remaining openings or apertures of the frame unit are covered and closed by applying the sheeting material providing a sealing and/or insulating barrier.

The sheeting material may consist of, or include, a thin plastics skin or membrane connected by any convenient fastening or connection to the top and bottom members, end members and intermediate pillars, and any cross-members.

It is more generally preferred, however, that the sheeting should consist of, or include, a plastics foam material, especially a low flammability cellular foam material having highly favorable thermal insulation and rigid properties such as, for example, polyisocyanate foam materials marketed under the Trade Name "Qwellflam". Such foam plastics materials may be applied by injection into the apertures or openings, while the frame is assembled in a simple jig, and may form a sheet-like infill of substantial thickness extending between and bonding to adjacent frame members. Also, embedded in the foam material, there may be additionally provided a thin metal plate, again extending between adjacent frame members, which can provide an effective fire barrier. The foam material should also fill the hollow frame members.

The fully fabricated frame units can then be delivered to the building site for assembly and erection, preferably on a preconstructed and levelled horizontal base prepared by using a skeletal sub-frame, which may be composed of elongate metal sections, to provide a mold for casting a concrete raft.

The closure of the openings of the frame units by the sheeting has a practical advantage during the building construction in that, after quick erection to provide external wall sections or panels followed by a quick roofing, the external structure can be sufficiently weatherproof to permit workmen to complete the interior under inclement weather conditions.

The roof may be supported on the adjoining top frame members of the assembled frame units, or on connectors coupling adjacent frame units together. The roof can be of conventional design including a plurality of roof trusses to which, for example, battens are secured for supporting tiles or other roofing material.

In the completed structure, the frame units will generally be enclosed by an outer cladding and an inner lining. The cladding may be of any suitable type, including brick, precast slabs, stone, wood or even synthetic material panels. The lining may also be of a conventional type such as plasterboard or panels of suitable finishing material.

BRIEF DESCRIPTION OF DRAWINGS

By way of example, practical applications of the invention are illustrated in the accompanying drawings.

In said drawings.

DESCRIPTION OF SPECIFIC EMBODIMENTS

Figure 1:
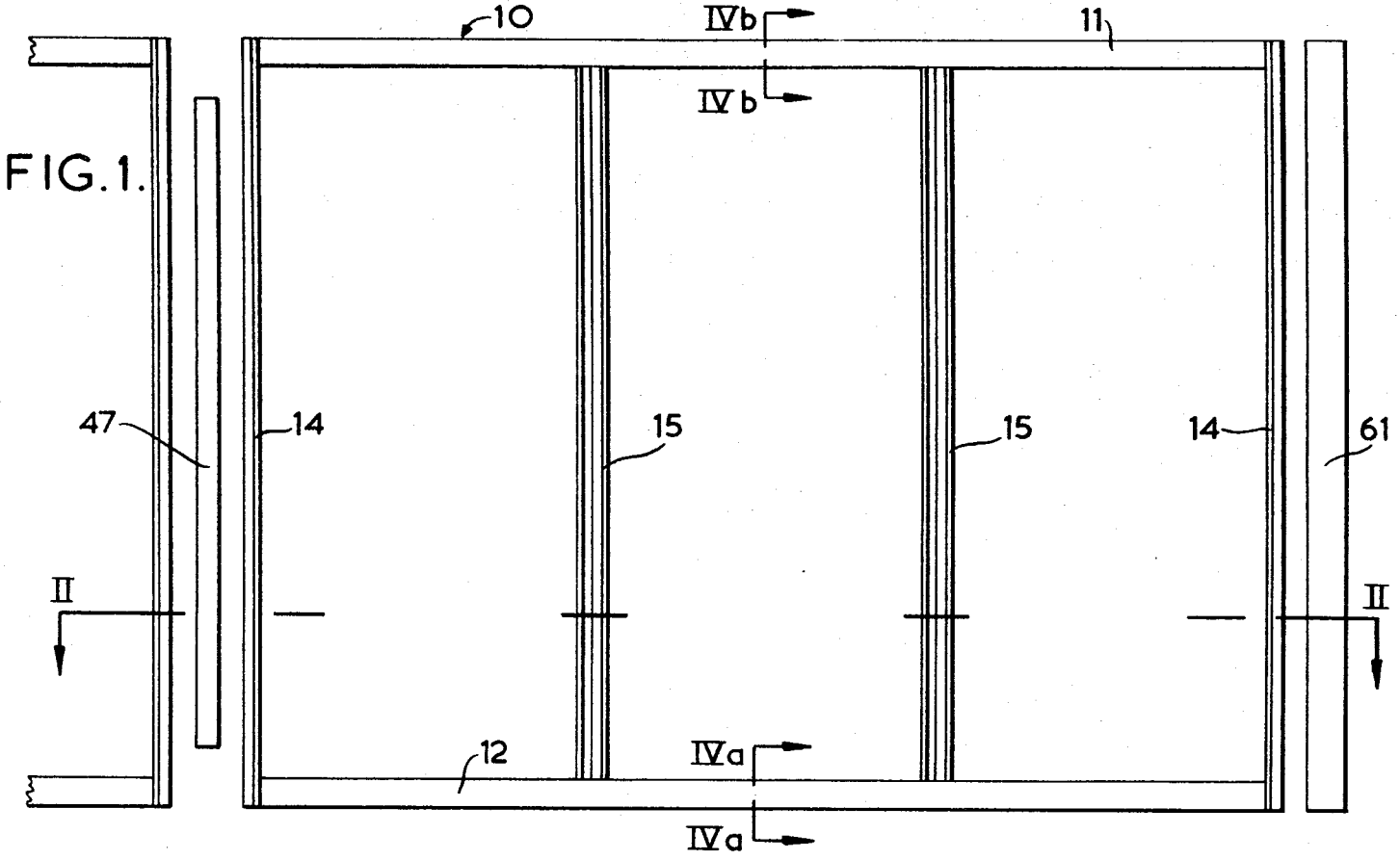
FIG. 1 illustrates in elevation the basic structure of a skeletal metal frame making up a building frame unit in accordance with the invention together with part of an adjacent unit and interconnecting assembly components.
Figure 2:
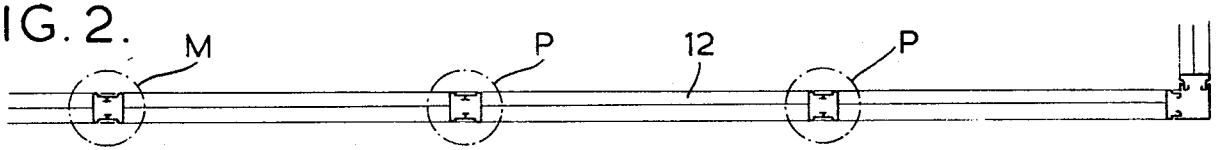
FIG. 2 is a horizontal section along line II-II of FIG. 1, after adjacent frame units have been assembled and connected together as in erecting and fabricating a building structure.

In the drawings, building frame units 10 are shown, assembled and connected in endwise relationship to one another, to form an external wall of a building structure, said building unit being illustrated in several of the Figures primarily in its basic form of a rectangular skeletal metal frame. This frame is built up of top and bottom elongate frame members, 11 and 12, connected together by elongate end frame members 14, forming vertical end pillars, and by intermediate frame members or intermediate pillars 15 spaced from and parallel to the end members 14.

The intermediate pillars 15 are connected in selected positions to the top and bottom members 11 and 12, by riveted connecting brackets 17. In a slightly-modified structure, not illustrated, the connectors may be of a clamping type, in the form of box-like T-structures for example, which may permit subsequent positional adjustment of the intermediate pillars if required.

Figure 6:
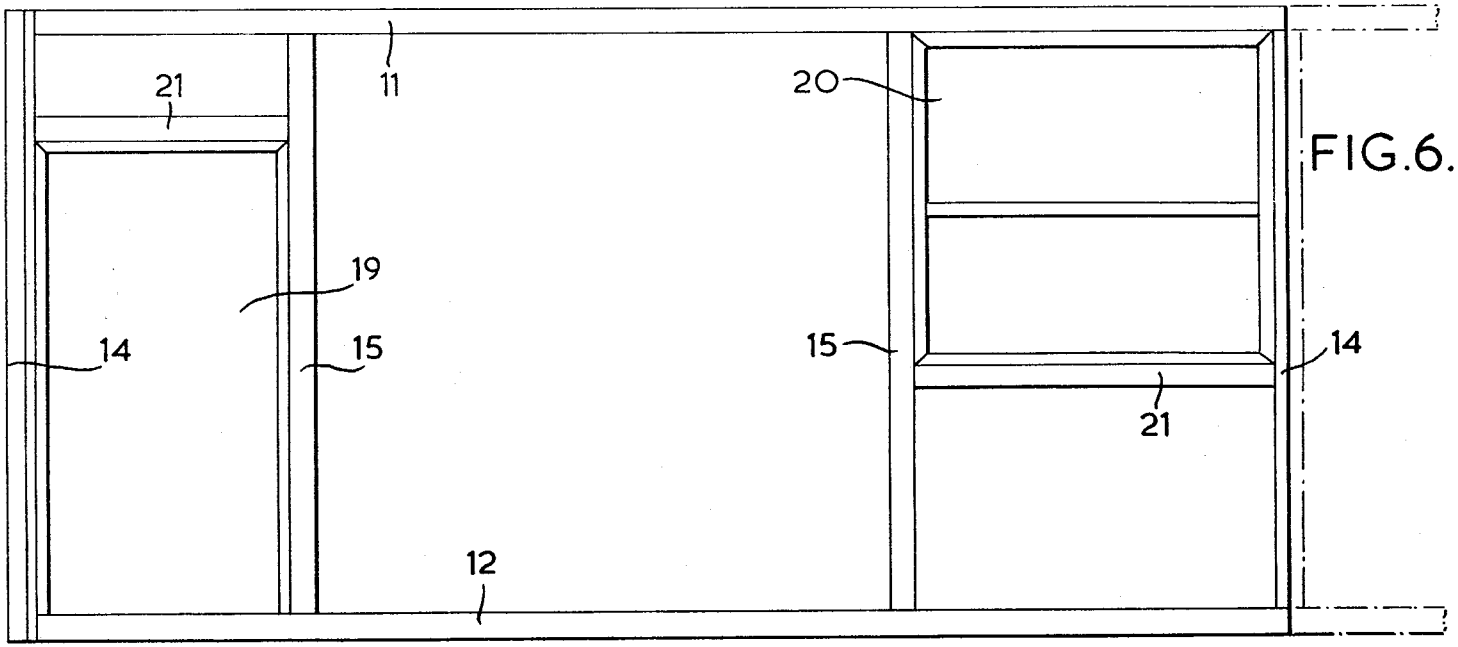
FIG. 6 is an elevational view of a slightly modified frame unit completed with additional door and window components.

FIG. 6 indicates the manner in which the intermediate pillars may be positioned to suit additional components such as a door assembly 19 and window assembly 20 accommodated between adjacent vertical members and adjacent additional horizontal cross members 21.

Figure 4:
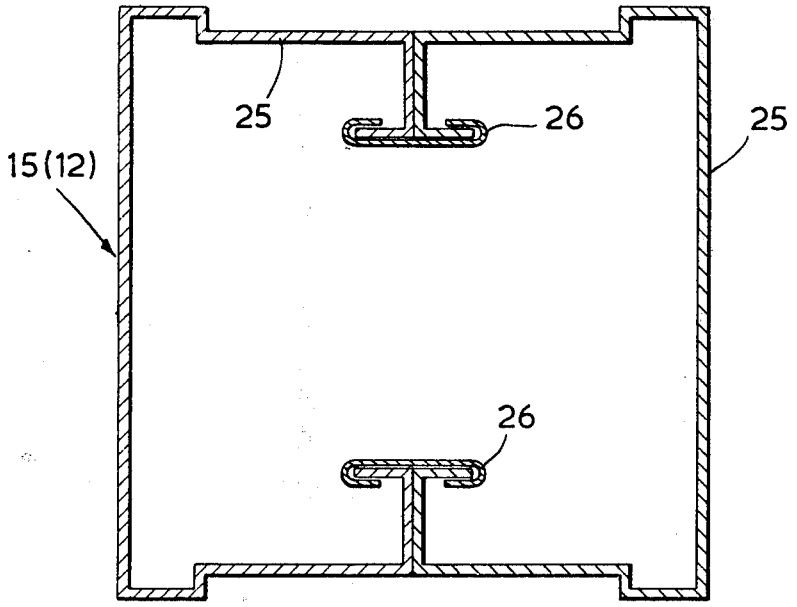
FIG. 4 is a cross-sectional detail view on a larger scale of the parts marked "P" in FIG. 2 representing the interconnection of opposed flanged channel sections to provide box-like structures for the intermediate frame members, or it equally represents a sectional view on lines IV*a*–IV*a* or IV*b*–IV*b* through the longitudinal frame members of FIG. 1.

The individual frame members are each formed by lengths of flanged channel form hollow metal sections 25. The end members 14 consist of a single length of this channel section 25 arranged with the open mouth presented outwardly. However, the other frame members preferably consist of two such lengths assembled with their mouth portions in opposed confronting relationship and connected together by C-cleats 26 engaging respective pairs of inturned flanges, as indicated most clearly in the sectional views of FIGS. 4 and 7.

In assembly of each individual frame unit 10, internal angle connectors similar to the brackets 17 are conveniently used to connect each end frame member to respective top and bottom members. After fitting the additional door, window, or other components, the apertures provided by the remaining openings between adjacent parallel frame members are closed over by sheeting which has been omitted for clarity in many of the Figures.

Figure 7:
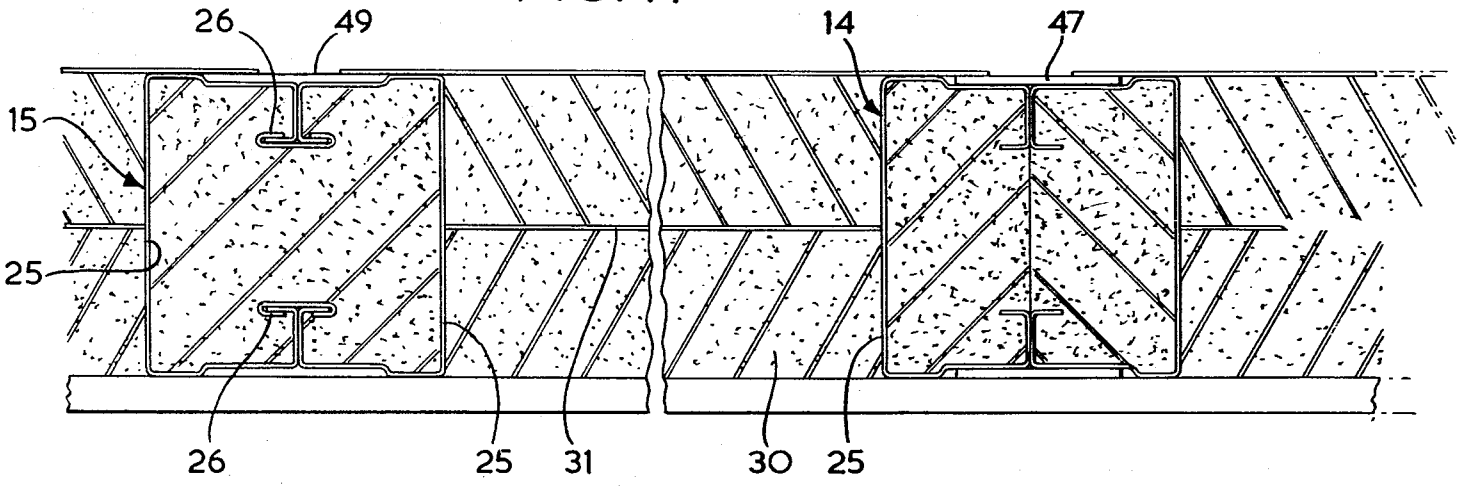
FIG. 7 is a horizontal sectional view, again on an enlarged scale and partially broken away, through part of two adjacent assembled and interconnected frame units showing the plastics foam material infill which is introduced to provide a sealing and/or insulating barrier closing open spaces in the frame units and filling the hollow frame members thereof.
Figure 8:
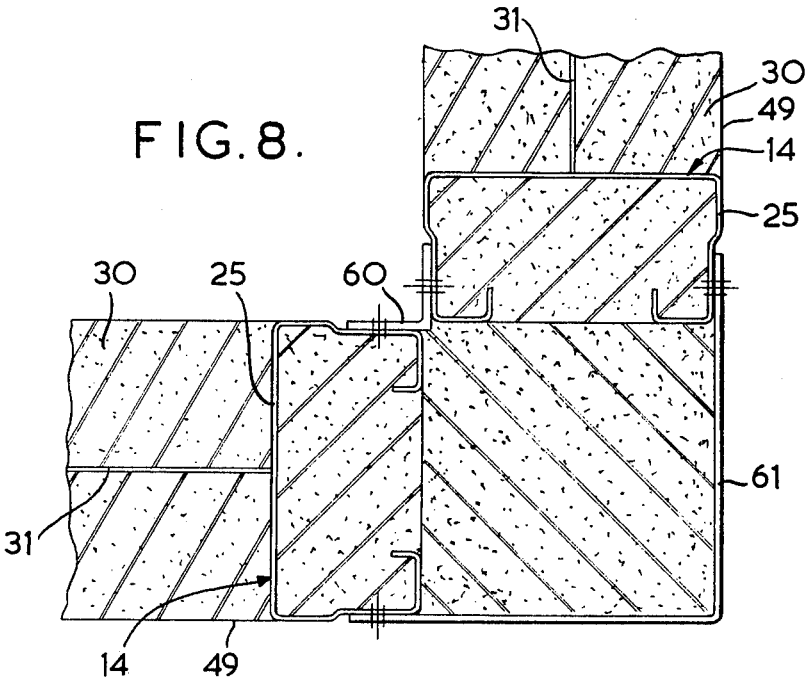
FIG. 8 is a view similar to FIG. 7 but showing in detail a corner portion of an assembly.

The sheeting may comprise an external or internal thin plastics skin, or membrane, as shown at 49 in FIGS. 7 and 8. However additionally or alternatively, a plastics foam material 30 (see FIGS. 7 and 8) may provide a low flammability thermally insulating infill extending between and bonded to adjacent frame members. Embedded in the plastics foam there may be a thin metal plate 31 providing a fire barrier. Also, as indicated in FIGS. 7 and 8, the channel sections of the frame members are also filled with the plastics foam material in the final assembly.

Figure 3:
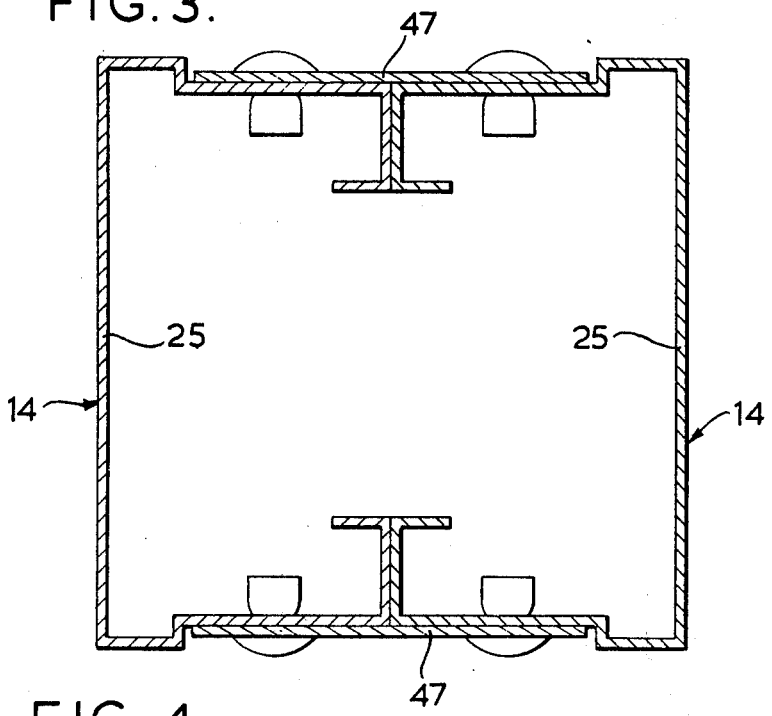
FIG. 3 is a cross-sectional detail view on a larger scale of the part marked "M" in FIG. 2 representing the interconnection between opposed end frame members of adjacent frame units.
Figure 5:
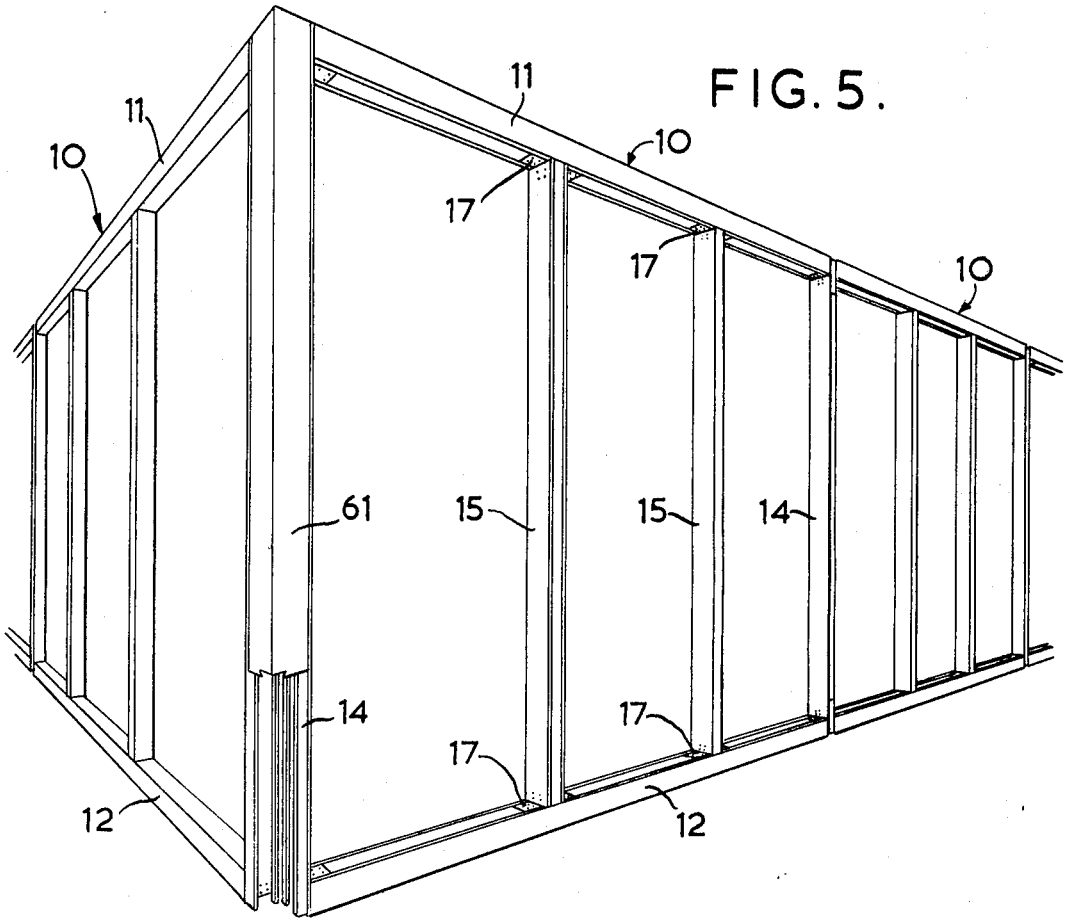
FIG. 5 is a somewhat simplified schematic perspective view of a corner portion of an assembly.

It will be seen that the aligned endwise assembly of the frame units 10 also brings the respective adjacent channel section end members 14 together in mouth-to-mouth opposed confronting relationship again to give a box-like formation, and these end members of adjacent frame units are joined by elongate connecting plates 47 riveted in place (see FIG. 3). FIGS. 5 and 8 illustrate most clearly the preferred type of corner formation for adjacent units in angular relationship, from which it will be seen that the units are interconnected by an internal corner closure angle section member 60 and external corner closure angle section member 61, each secured by riveting to the respective frame end members.

Figure 10:
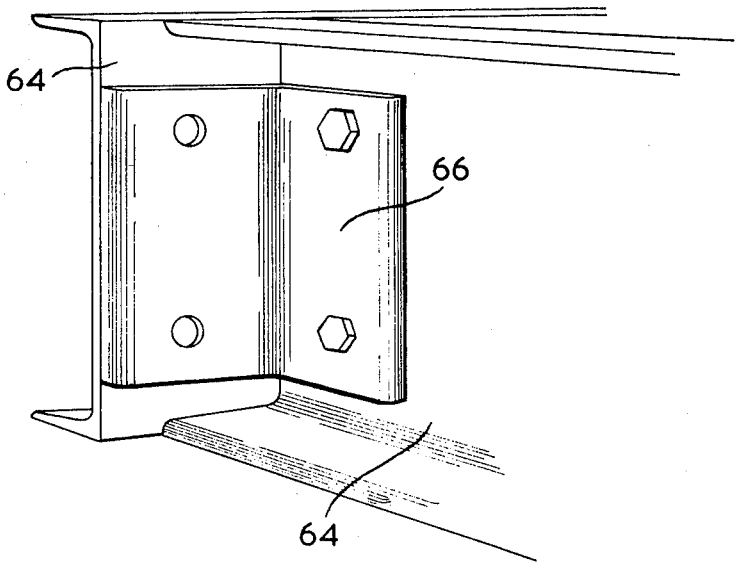
FIG. 10 is a fragmentary detail view of the corner of a skeletal sub-frame portion of the base sub-frame structure of FIG. 9.
Figure 9:
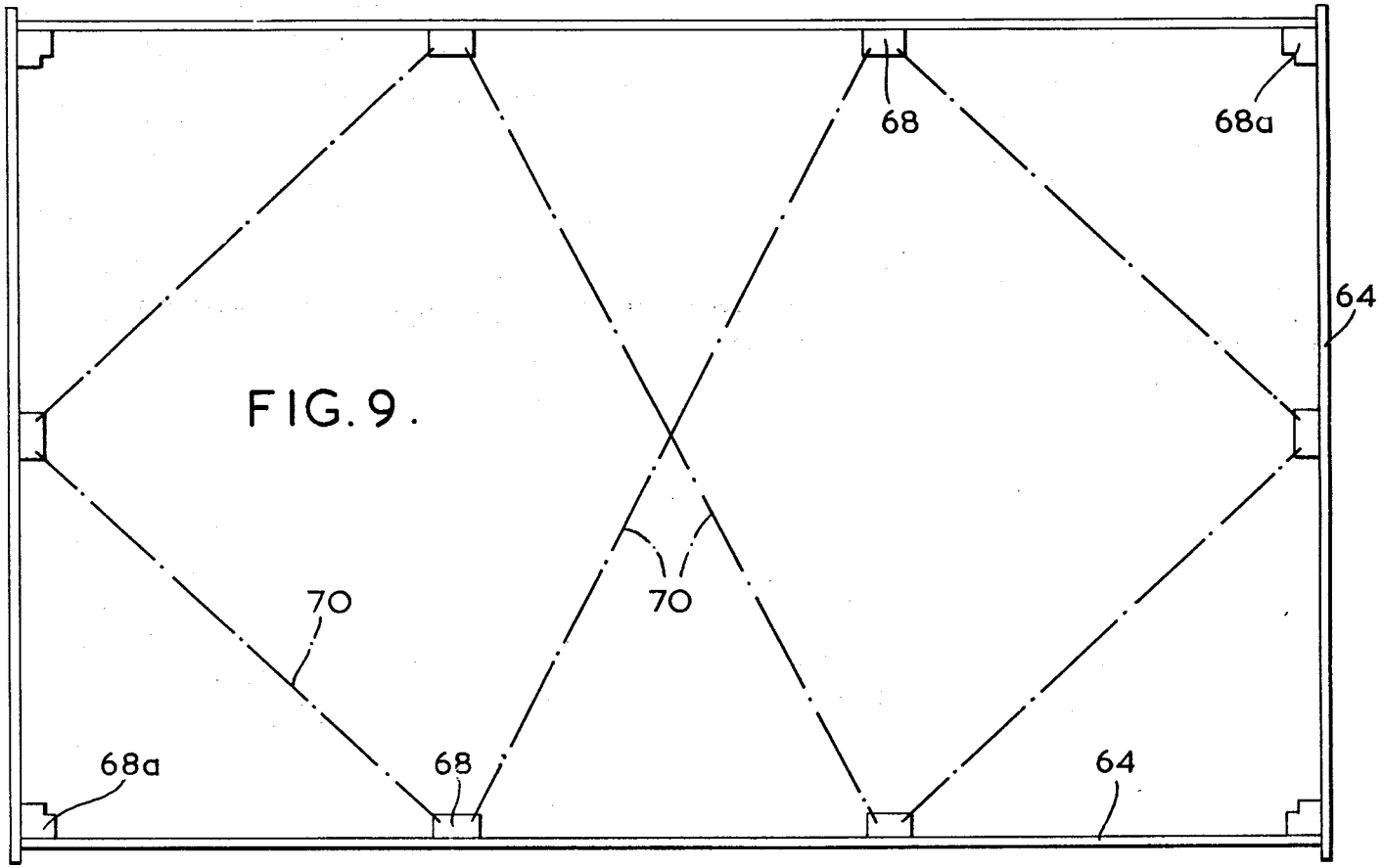
FIG. 9 is a plan view showing the fabrication of a base sub-frame structure upon which the frame units may be erected at the building site.
Figure 11:
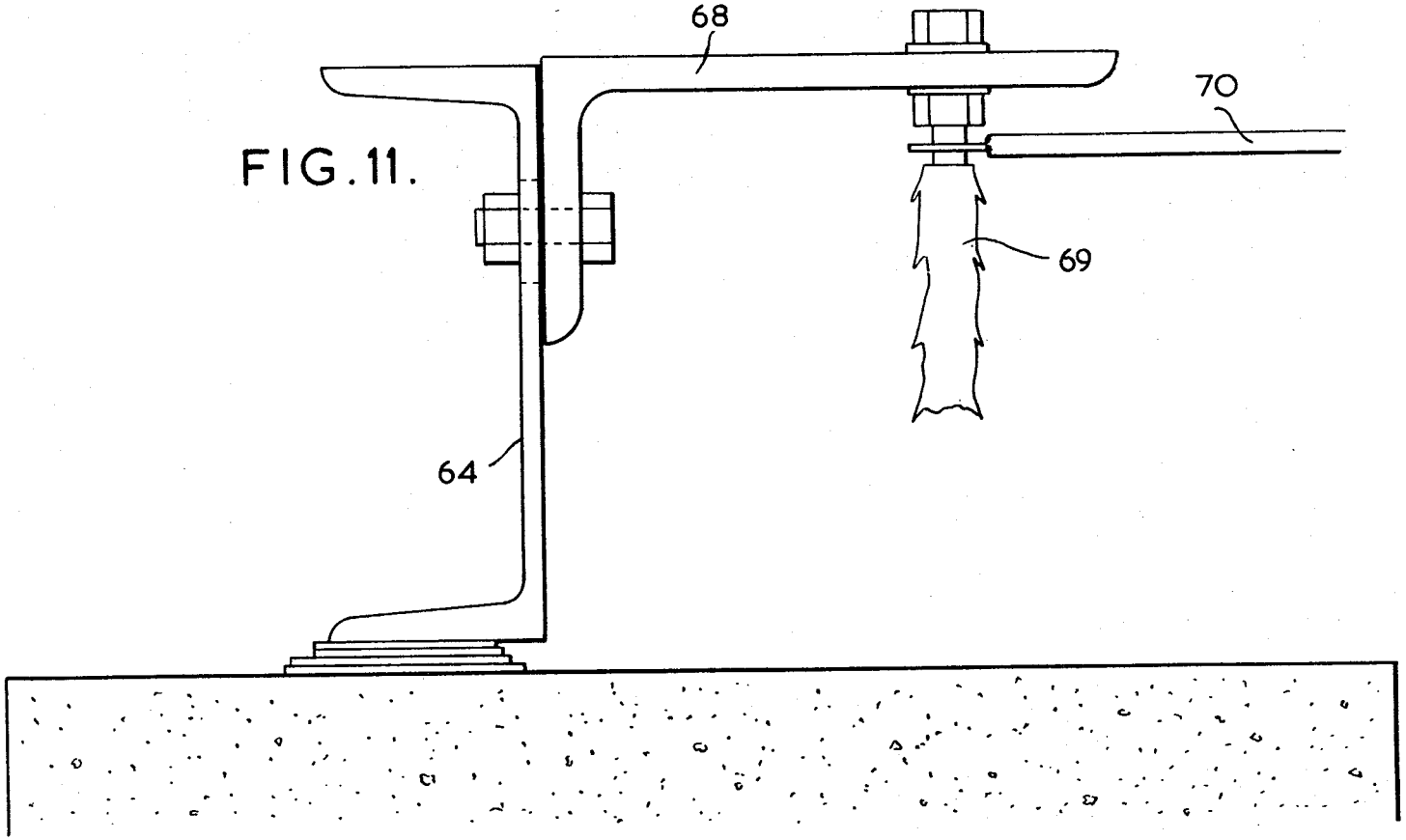
FIG. 11 is a view on a larger scale of a portion of the sub-frame structure during fabrication.

In employing the building system of this invention, as previously mentioned, the assembled frame units are preferably assembled and erected on site on a preconstructed and levelled horizontal base prepared by using a skeletal base sub-frame. The fabrication of a typical base will be further described with reference to FIGS. 9, 10 and 11. First, a rectangular skeletal base sub-frame may be laid out using elongate metal channel sections 64 supported upon concrete strips and connected at the corners by external fish-plate brackets 66 bolted in position (see FIG. 10). The channel sections 64 are levelled by packing or shims, and at intervals along their length, inwardly projecting angle plates 68 are bolted in position. These are fitted with depending rag bolts 69 which also provide anchorages for tie rods 70 which are adjusted in length to brace the structure. After levelling and trueing, this skeletal base sub-frame is used as a mold for casting therein a concrete floor slab or raft, substantially up to the level of the top flange of the angle plates 68 (not shown in FIG. 11). In other words, the leveling and trueing of the base sub-frame fixes all the plates 68 in precise predetermined final positions with respect to each other before casting. Thereafter, upon setting of the concrete, the sub-frame channel sections 64 may be removed after removing the nuts on the bolt fixings to the angle plates 68 (and to corner angle plate members 68*a*) and unbolting the corner fish-plate bracket connectors 66.

A flexible damp proof plastics membrane may be laid over the entire upper surface of the prepared base foundation, and the frame units 10 are assembled and erected with their bottom longitudinal frame members 12 laid over and resting upon the angle plates 68 and corner angle plate members 68*a*. In addition, at intermediate locations, channel section metal shoes (not shown) may be provided on the concrete floor slab or raft to receive the bottom frame members 12 which are finally fixed by riveting at intervals.

Figure 12:
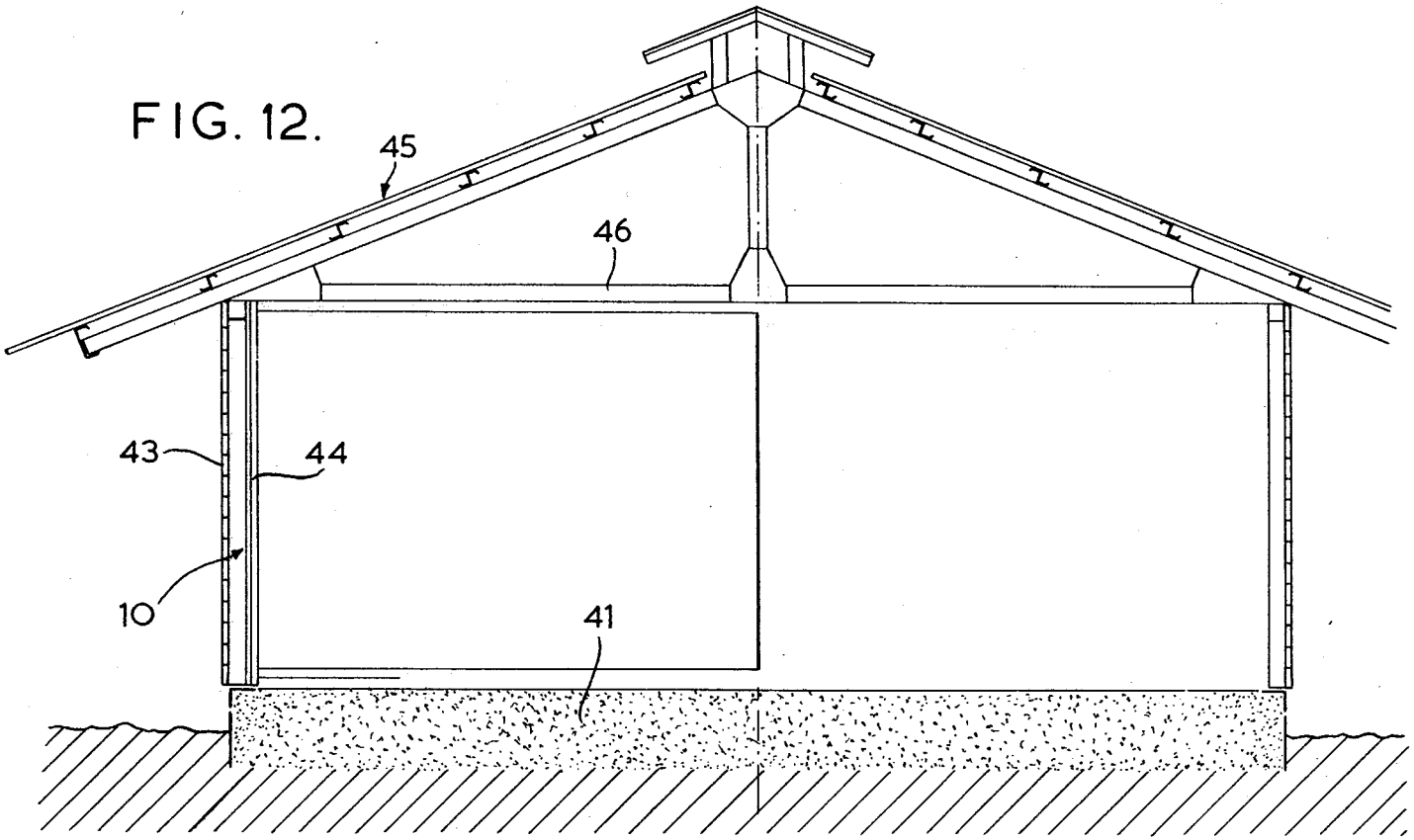
FIG. 12 is a simplified diagrammatic part-sectional view of a completed building structure.

FIG. 12 represents a completed building structure and indicates a manner in which the frame units 10 may be laid upon a concrete base foundation 41 which may be prepared as described above. FIG. 12 also indicates the manner in which the completed and erected frame units 10 may be enclosed by external cladding 43 and an internal lining 44, and how a conventional roof assembly 45 may be incorporated with roof trusses 46 supported, by suitable connecting means, upon the top of the frame units forming the external wall sections.

It may be pointed out that forming the frame members of pairs of flanged metal channel sections as herein described has a space-saving advantage in long distance transport and shipping of the components for assembling the building frame units because the individual channel sections can be packed together in a nested relationship which requires substantially less space than would be needed by hollow one-piece metal box-section frame members giving equivalent mechanical strength. Also, the configuration of the channel sections with their inturned and re-entrant flanges, and the filling of their interiors with rigid plastics foam material, is a very important and advantageous feature not only from the aspect of giving a high strength/weight ratio, but also from the aspect of giving a high durability and resistance to corrosion since there are no externally exposed free edges of the metal sections which commonly represent a weak spot for corrosion to develop.

We claim:

1. A method of constructing in situ a building structure having a plurality of building frame wall units disposed upon a supporting base foundation, said method comprising the steps of:

(a) juxtaposing a plurality of elongate sub-frame sections to define a horizontal skeletal base sub-frame, (b) releasably fastening adjacent sub-frame sections together externally of the sub-frame, (c) releasably fastening a plurality of separate individual base plate means to said sub-frame sections, (d) connecting tie rods between at least some of the base plate means to brace the sub-frame sections of the base sub-frame, (e) leveling and trueing the sub-frame to fix all the base plate means in precise predetermined final positions with respect to each other before casting, then (f) casting a molded floor slab of rigid hard-setting molding material within said sub-frame to fix said base plate means and tie rods into said floor slab; and (g) removing said sub-frame sections so that the base sub-frame is dismantled and the base plate means and tie rods remain fixed into the floor slab to provide the supporting base foundation of the building structure.

2. A method as defined in claim 1, wherein a flexible sheet of plastic material is disposed over the entire upper surface of the molded floor slab and base plate means before erecting and fixing building frame wall units on the supporting base foundation.

3. A method as defined in claim 2, wherein channel section shoe means are fixed at intervals along the supporting base foundation to receive bottom horizontal frame members of said building frame wall units.

4. A method as defined in claim 1, wherein building frame wall units are erected and fixed in endwise interconnected relationship with respect to each other on the supporting base foundation, and roof trusses are fitted to span between building frame wall units of the external wall located at opposite sides of the erected structure of wall units and are connected to and supported by the top of said wall units.

5. A method as defined in claim 1, wherein apertures are located between horizontal frame members and vertical frame members in the building frame wall units composed of skeletal metal frames, and a thermally insulating rigid plastics foam material fills said apertures.

6. A method as defined in claim 5, wherein the horizontal and vertical frame members each have a hollow box-like interior including a pair of channel sections having inturned and re-entrant marginal flanges assembled in opposed mouth-to-mouth relationship, the hollow box-like interior of said frame members being filled with thermally insulating rigid plastics foam material.

7. A method as defined in claim 1, wherein the skeletal base sub-frame has a rectangular configuration and the base plate means includes a plurality of brackets each having an angular configuration and being positioned with one at each corner and at least one along each side defined by an elongate sub-frame section and intermediate adjacent corners.

8. A method as defined in claim 1, wherein building frame wall units are erected and fixed in endwise interconnected relationship with respect to each other on the supporting base foundation.

9. A method as defined in claim 8, wherein said base plate means includes a plurality of base plate elements positioned at each corner of the supporting base foundation and along each side of the foundation intermediate adjacent corners, each building frame wall unit has a bottom horizontal frame member which is spanned over and supported by adjacent base plate elements.

10. A method as defined in claim 1, wherein a plurality of said frame wall units are connected by C-cleats engaged with respective pairs of adjacent re-entrant flanges of the channel sections to form box-like elongate structures.

* * * * *